United States Patent [19]

Pearl

[11] 3,955,458

[45] May 11, 1976

[54] CUTTING APPARATUS WITH SHARPENER AND SHARPENING METHOD

[75] Inventor: David Raymond Pearl, West Hartford, Conn.

[73] Assignee: Gerber Garment Technology, Inc., East Hartford, Conn.

[22] Filed: Sept. 17, 1973

[21] Appl. No.: 398,255

[52] U.S. Cl. ..... 83/528; 83/925 CC

[51] Int. Cl.[2] ..... B26D 1/04

[58] Field of Search ..... 83/925 CC, 747, 528; 90/15 R

[56] References Cited

UNITED STATES PATENTS

| | | | |
|---|---|---|---|
| 245,149 | 8/1881 | Fowler | 83/925 CC |
| 3,715,945 | 2/1973 | Mochizuki et al. | 83/528 X |
| 3,780,607 | 12/1973 | Gerber | 83/925 CC |

*Primary Examiner*—Willie G. Abercrombie
*Assistant Examiner*—Z. R. Bilinsky
*Attorney, Agent, or Firm*—McCormick, Paulding & Huber

[57] ABSTRACT

A cutting apparatus for cutting pattern pieces from layups having a low stack height employs a cutting head having a small reciprocating blade suspended from a carriage which moves over the layup. The drive motors for reciprocating the blade and orienting the blade in a particular cutting direction about a $\theta$-axis remain in a stationary position on the cutting head as the blade is oriented and elevated in and out of cutting contact with the layup. A blade sharpener is suspended from the head with the cutting blade and is energized by spinning the blade about the $\theta$-axis. Drilling is also accomplished by spinning the blade.

5 Claims, 11 Drawing Figures

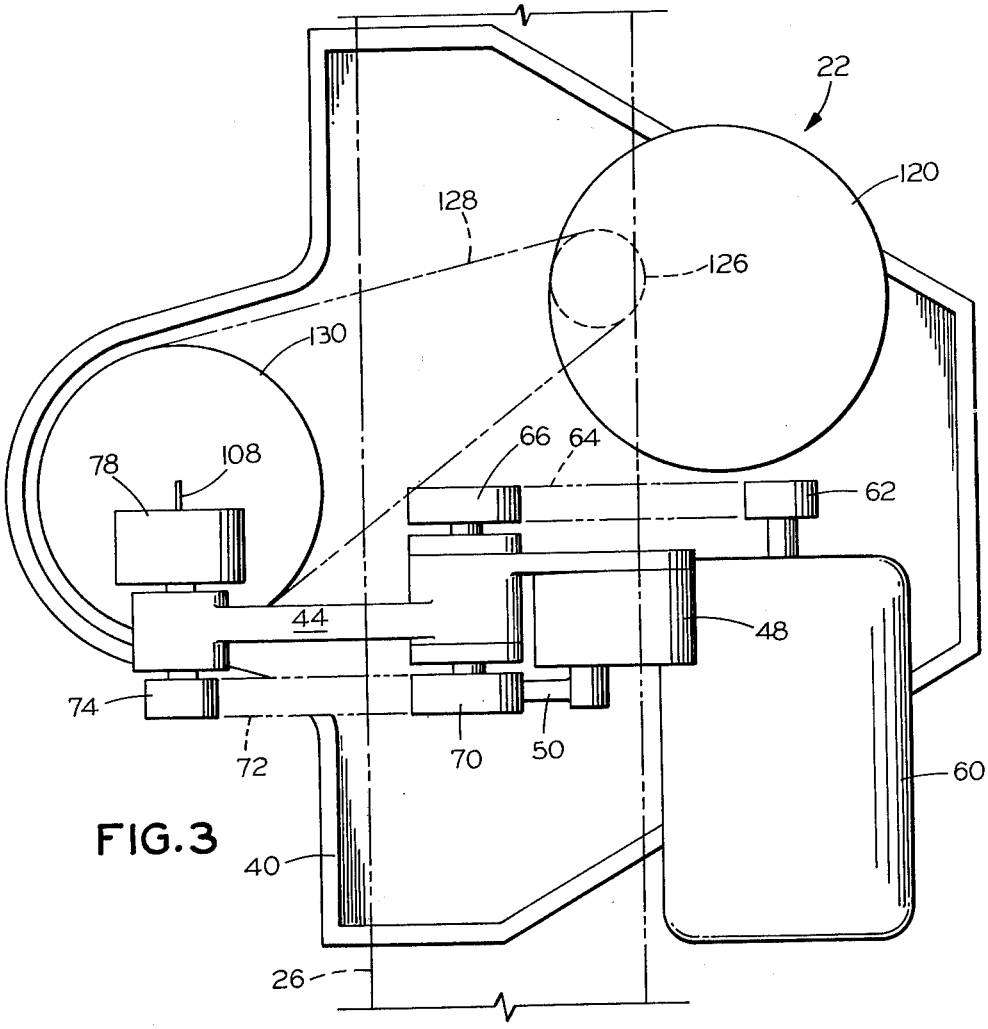
FIG. 3
FIG. 10
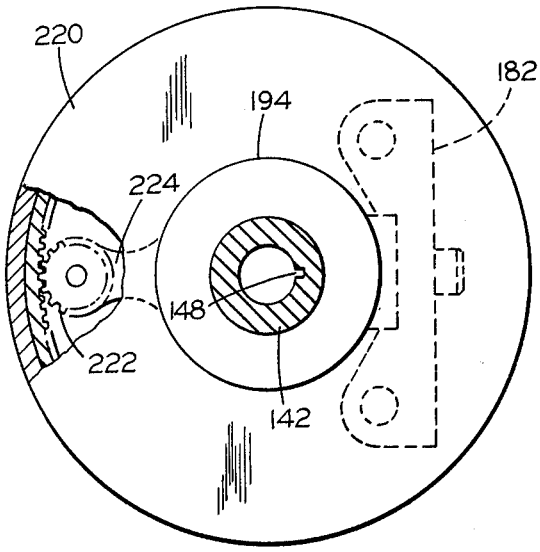
FIG. 11
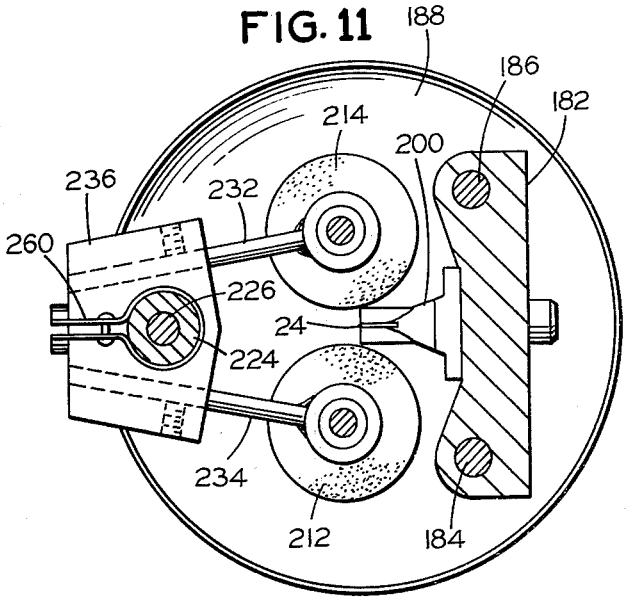

108
166
162
164
160
170
168
24

78
108
44
98
96
100
94
160
40
130
140
128
142
148
150
190
192
144
146
252
256
220
196
194
250
10
222
180
254
224
228
24
11
260
230
182
238
232
210
234
236
240
226
242
214
202
200
188
122
184

108
162
160
168
24

CUTTING APPARATUS WITH SHARPENER AND SHARPENING METHOD

BACKGROUND OF THE INVENTION

The present invention relates to apparatus for cutting sheet material and, more particularly, to a numerically controlled cutting apparatus suitable for cutting pattern pieces from fabric layups having a low stack height.

The use of numerically controlled cutting tools in the garment, automobile and other fabric-cutting industries is well established. Numerically controlled equipment is capable of cutting large quantities of pattern pieces from layups with as many as 150 plies of sheet material with high speed and accuracy. Cutting programs control the operation of a cutting tool, such as a reciprocating cutting blade, and cause it to translate through high or deep layups while the layups are held in a spread condition on a cutting table. Relative movement between the cutting blade and the layups can be produced by moving the cutting blade or the layup or both under program control.

U.S. Pat. No. 3,495,492 having the same assignee as the present invention discloses a prior art cutting apparatus in which the layup of sheet material is held in position on a vacuum table. The use of a vacuum hold-down technique assists the cutting operation by holding each ply of sheet material in the layup in position relative to the other plies and the cutting surface over which the operation takes place so that precise correspondence between patterns cut from the top and bottom plies results. While cutting machines such as disclosed in the above-referenced patent may be used in cutting layups of different depths or heights above the supporting surface of the cutting table, they are designed to withstand the maximum loads experienced while cutting deep layups of 6 inches or more. Correspondingly, their speed and agility in cutting layups of low stack height are somewhat limited.

Accordingly, it is a general object of the present invention to disclose a cutting head for use in cutting machines that operate upon layups of low stack height. The head is constructed with low translation and polar moments of inertia to operate efficiently in low-stack-height layups in response to a simplified cutting program.

SUMMARY OF THE INVENTION

The present invention resides in an apparatus for cutting sheet material while the material is held on a support surface in a spread condition. The cutting apparatus comprises a mounting platform positioned above the support surface on which the sheet material is held. A mounting arm supported from the platform is pivotally connected to the platform for tilting motion about an axis generally parallel to the support surface. A motor-driven cutting tool is suspended from the mounting arm and above the support surface so that the tool moves with the tilting motion of the arm into and out of cutting engagement with sheet material on the surface. Tool drive means are mounted on the platform and include a drive train from the platform to the cutting tool suspended from the arm.

The cutting tool is a mechanical cutting blade and, hence, means are provided for orienting the suspended tool about an axis perpendicular to the support surface and relative to the sheet material so that the tool and the sheet material may be translated relative to one another with the tool positioned tangent to the cutting path at each point. The means for orienting the cutting tool is also mounted on the platform and is connected with the tool so that the tool may be moved in and out of cutting engagement with the sheet material without moving the orienting means.

A blade sharpener is suspended from the cutting platform with the cutting blade and is operated by selectively engagable drive means when the blade is spun about the orientation axis.

A method of drilling holes in the sheet material with the cutting apparatus is accomplished by spinning the cutting blade about the orientation axis.

The entire cutting head is designed for low inertial loading and, therefore, may operate at high speed with great alacrity and nimbleness.

BRIEF DESCRIPTION OF THE DRAWINGS

FIG. 3 is a top plan view of the cutting head in FIG. 2.

FIG. 10 is a cross-sectional view of the blade sharpener as viewed along the sectioning line 10—10 in FIG. 7.

FIG. 11 is a cross-sectional view of the sharpener as viewed along the sectioning line 11—11 in FIG. 7.

DESCRIPTION OF THE PREFERRED EMBODIMENTS

Figure 1:
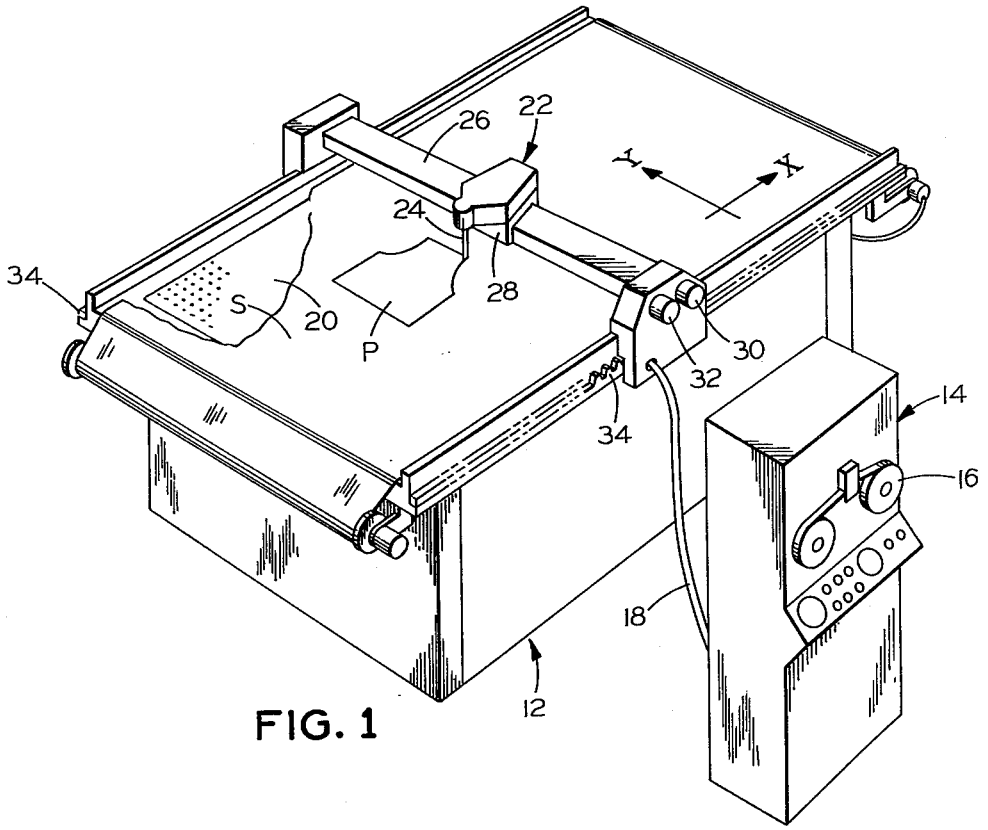
FIG. 1 is a perspective view of a cutting apparatus in which the present invention resides.

FIG. 1 illustrates a cutting apparatus, generally designated 10, in which the cutting head of the present invention is employed. The cutting apparatus is comprised of a cutting table 12 and a control computer 14 which controls the operation of the table 12 in accordance with a cutting program defined on a program tape 16. Commands from the computer 14 are transmitted to the table through a cable 18 and information from the table is also fed back to the controller thorugh the cable in the course of a cutting operation.

The cutting table 12 has a penetrable support surface 20 on which sheet material S is laid in a spread condition. The material may be supported in rolls at the opposite longitudinal ends of the table for spreading in either single-or multi-ply layups on the surface. A cutting head 22 including a reciprocating cutting blade 24 is mounted above the support surface 20 by means of an X-carriage 26 which traverses the cutting table 12 on ways in the illustrated X-direction and a Y-carriage 28 which is mounted on the X-carriage and translates on ways relative to the X-carriage and the table in the illustrated Y-direction. An X-drive motor 30 mounted on the carriage 26 has pinions (not shown) engaging gear racks 34 at the opposite sides of the table 12 and is controlled by the computer 14 in accordance with the cutting program. A Y-drive motor 32 also mounted on the carriage 26 engages the Y-carriage 28 by means of a lead screw (not shown) or equivalent drive means such as a toothed-belt-and-pulley system, and is controlled by the computer 14 in accordance with the cutting program.

Combined motions of the carriages 26 and 28 permit the blade 24 to be translated over the surface 20 of the table in cutting engagement with the sheet material S. The controlled motions of the carriages and the blade 24 allow pattern pieces, such as the piece P, to be cut from the sheet material. Ordinarily, a marker identifying an array of pattern pieces in closely spaced relationship is cut from the sheet material rather than the single pattern piece P illustrated.

To permit the blade 24 to completely penetrate the sheet material along the entire periphery of the pattern piece P, the bed of the table defining the support surface 20 is preferably a penetrable bed formed by blocks of foamed plastic or bristled mats. A vacuum system associated with the penetrable bed holds the material tightly against the surface 20 and prevents the material from shifting on the surface as the cutting operation progresses. If the material forming the layup is air-pervious, it may be desirable to position an overlay of air-impervious material, such as a sheet of polyethylene on the sheet material to assist the holddown operation. A penetrable cutting table having a vacuum holddown system of this type is disclosed in U.S. Pat. No. 3,495,492 referenced above.

Figure 4:
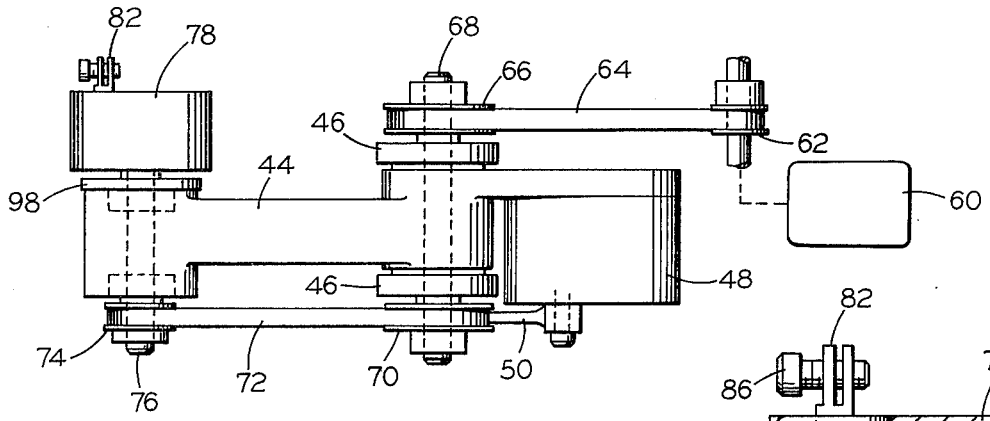
FIG. 4 is a top plan view of the blade drive mechanism on the cutting head.
Figure 2:
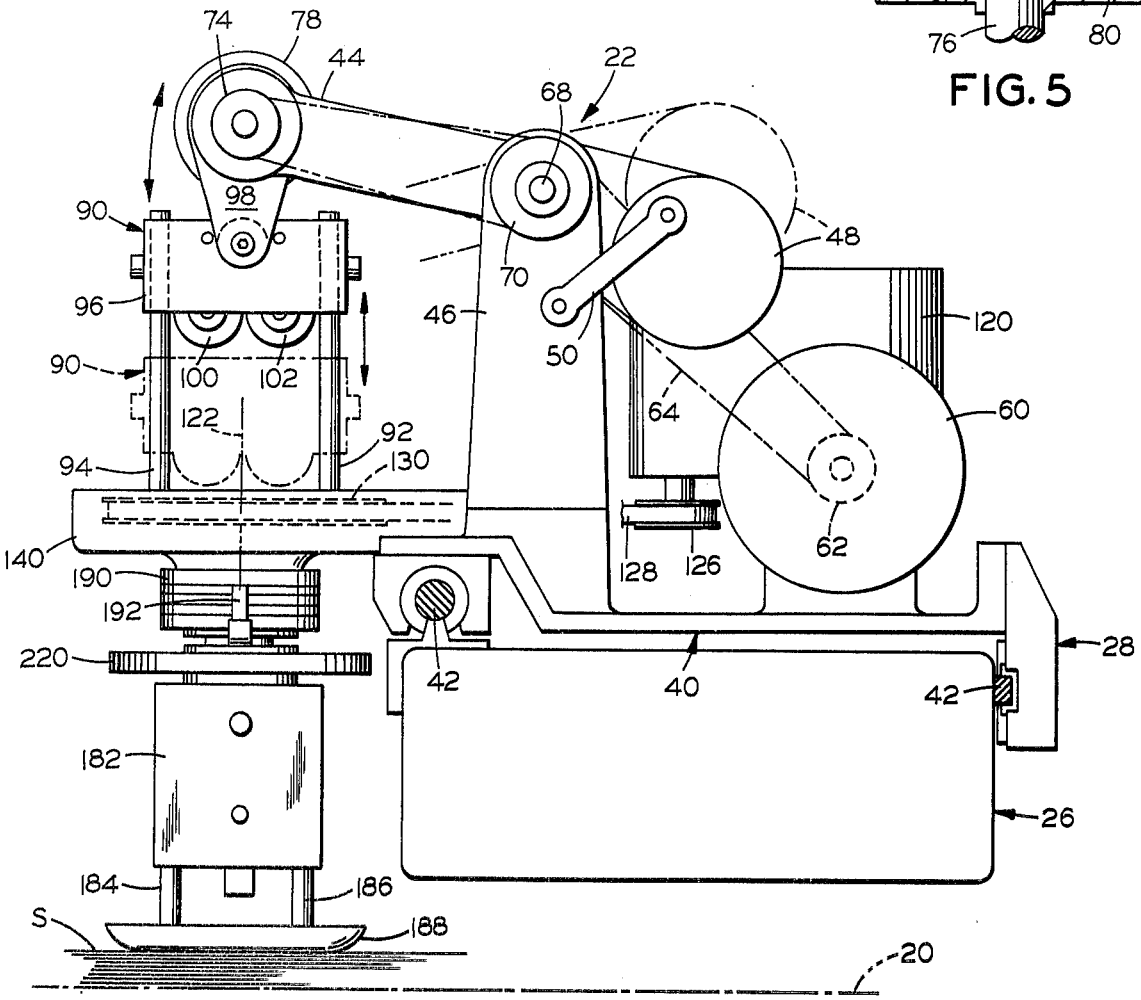
FIG. 2 is a side elevation view of the cutting head of the present invention mounted on the carriages of the cutting apparatus.

FIGS. 2, 3 and 4 illustrate in greater detail the features of the cutting head 22 mounted on the carriages 26 and 28. All of the components of the cutting head are supported on a mounting plate or platform 40 which may be either attached directly to or form a part of the Y-carriage 28 on ways 42. The cutting blade 24 is suspended from a pivotal mounting arm 44 which tilts relative to the support surface 20 of the cutting table on upright lugs 46 fixed to the mounted plate 40. Connected to the mounting arm 44 is a rotary solenoid 48 and a connecting rod 50 extending from the rotary output of the solenoid to the upright lugs 46. The rod 50 permits the solenoid 48 to move the arm 44 and correspondingly the cutting blade 24 between an upper position in which the blade is out of cutting engagement with sheet material on the surface 20 and a lower position in which the blade is operated in cutting engagement with the sheet material.

A reciprocation drive motor 60 mounted on the plate 40 is connected in driving relationship with the blade 24 by means of a drive train through the pivot axis of the arm 44 and lugs 46. As seen in FIG. 4 the drive train is comprised of a pulley 62, a drive belt 64, a pulley 66, axle shaft 68, a pulley 70, a drive belt 72, a pulley 74, axle shaft 76 and an eccentric 78.

Figure 5:
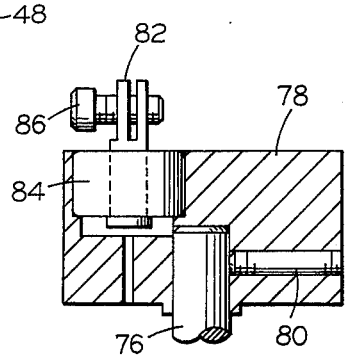
FIG. 5 is a fragmentary cross-sectional view of the eccentric in FIG. 4.

The eccentric 78 is shown in greater detail in FIG. 5. A set screw 80 holds the eccentric fixedly on the axle shaft 76 and a connecting crank pin 82 mounted by means of a bushing 84 in offset relationship to the shaft 76 includes a clamping screw 86 for attachment of the reciprocating blade linkage shown in detail in FIG. 8.

Figure 6:
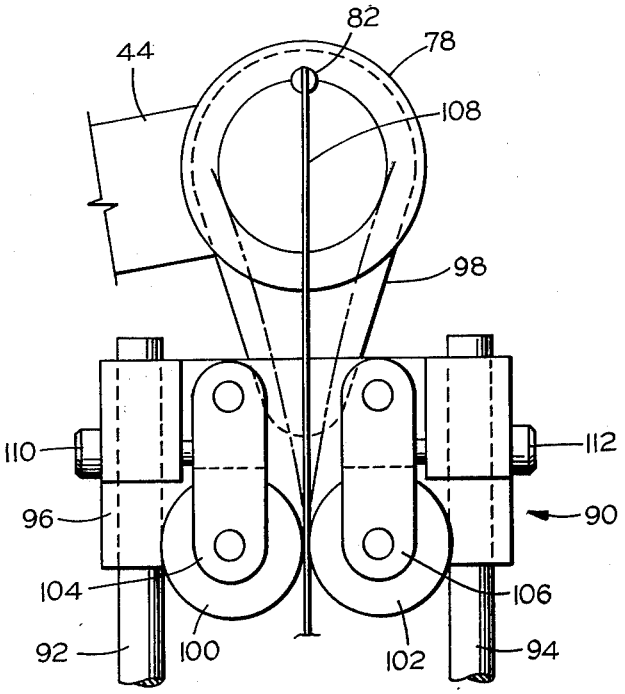
FIG. 6 is a fragmentary side elevation view of the eccentric in the drive mechanism and associated blade guide.

The reciprocating drive linkage between the eccentric 78 and the blade 24 passes through a guide assembly 90 illustrated in FIGS. 2 and 6. The guide assembly

90 is supported from the mounting plate on a pair of fixed slide rods 92 and 94 and includes a blade guide plate 96 which slides up and down on the rods 92 and 94 between the illustrated and phantom positions in FIG. 2. The up-and-down motion of the plate is caused by means of a connecting link 98 attached to the projecting end of the mounting arm 44 and, hence, corresponds to the lifting and plunging of the blade in and out of the sheet material. A pair of guide rollers 100, 102 are pendularly supported from the plate 96 by means of links 104 and 106, respectively, and are pressed by a pair of springs (not shown) against a flexible link 108 forming the upper portion of the reciprocating drive linkage to the blade. The compression of the springs can be varied by cap screws 110 and 112 to establish a centered position for the rollers 100 and 102.

It will be readily apparent that the flexible link 108 must bend between the limits illustrated in FIG. 6 as the connecting pin 82 is orbited in the eccentric 78. The guide rollers 100 and 102 establish a reference point through which the linear reciprocating motion of the cutting blade 24 takes place and the departure of the connecting pin 82 from points along the vertical axis through the reference point must be accommodated by the link 108. It will also be noted that the limited arcuate movement of the eccentric 78 is also accommodated by the link 108 as the mounting arm 44 tilts between its upper and lower positions.

Referring again to FIGS. 2 and 3, an orientation or $\theta$-drive motor 120 is shown mounted on the plate 40 adjacent the reciprocation drive motor 60. The cutting blade 24, as described in greater detail below, is suspended for rotation about a $\theta$-axis 122 in FIG. 2 perpendicular to the support surface 20 and the rotational position or orientation of the blade about the axis 122 is controlled by the $\theta$-drive motor 120 during a cutting operation so that the blade translates tangentially along cutting paths in the sheet material S. A drive train interconnecting the blade 24 and the motor 120 includes a toothed pulley 126 on the motor shaft, a toothed pulley 130 connected with the blade 24 as described in greater detail below, and a toothed belt interconnecting the pulleys 126 and 130. Like the X and Y position of the blade determined by the drive motors 30 and 32, the orientation of the blade must be precisely controlled; therefore, the toothed belt and pulley system is used and a feedback sensor (not shown) may also be connected to the $\theta$-drive motor 120 to supply position information to the control computer 14 in FIG. 1.

From the description so far, it will be understood that the cutting blade 24 is a reciprocating cutting blade that can be lifted in and out of cutting engagement with the sheet material S positioned on the cutting table 12. The blade 24 is translated along a cutting path in the sheet material by the X-carriage 26 and Y-carriage 28 and is maintained in tangential relationship with the cutting path by the $\theta$-drive motor 120. The cutting blade 24 may be continuously reciprocated as it is moved in and out of cutting engagement with the sheet material by virtue of the belt-pulley drive train extending from the motor 60 through the pivot axis of the support arm 44 to the eccentric 78 at the projecting end of the arm.

Figures 7, 8, 9:
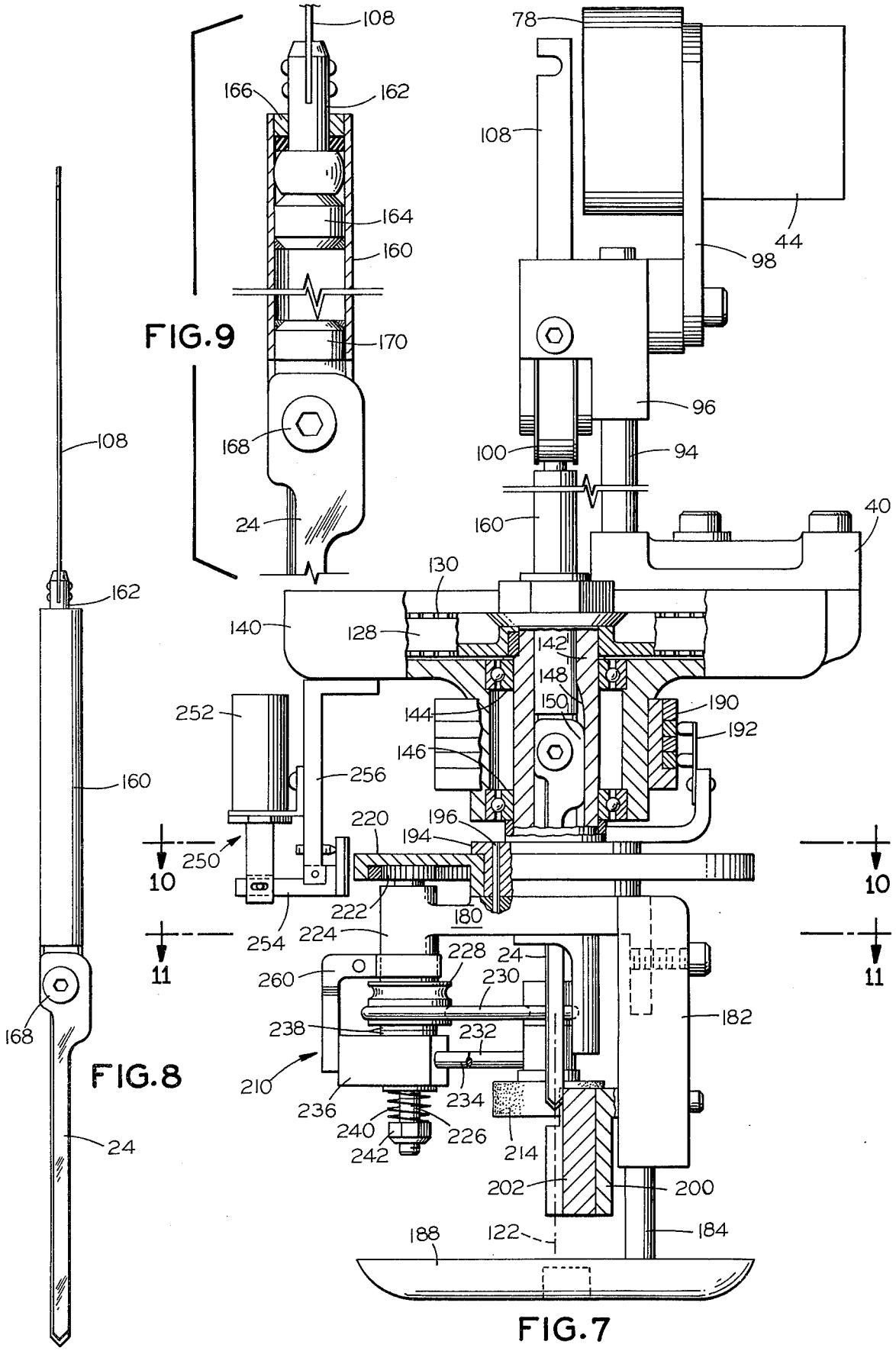
FIG. 7 is a side elevation view of the cutting head partially in section.
FIG. 8 is an assembly view of the reciprocating drive linkage connected to the cutting blade.
FIG. 9 is a fragmentary view of the drive linkage in FIG. 8 partially in section.

FIGS. 2 and 7 illustrate in detail the structure by which the cutting blade 22 is mounted for reciprocation, plunging and lifting and rotation relative to the mounting plate 40. A housing 140 is bolted to the mounting plate 40 in cantilever fashion and encloses the toothed pulley 130 which controls the rotation of the cutting blade 24. A hollow shaft or sleeve 142 is mounted for rotation about the $\theta$-axis in the housing 140 by means of roller bearings 144 and 146. The pulley 130 is keyed to the upper end of the sleeve 142 so that the sleeve rotates about the $\theta$-axis 122 in response to the control signals received by drive motor 120 in FIGS. 2 and 3. An internal groove 148 in the sleeve 142 receives a key or tang 150 at the trailing edge of the blade 24. The groove 148 extends axially along the sleeve 142 so that the tang 150 and groove 148 form a torque-transmitting, sliding connection between the blade and the toothed pulley 130. Rotation of the pulley 130 about the $\theta$-axis 122 causes the blade 24 to rotate correspondingly while the reciprocating motion of the blade takes place in the bore of the sleeve 142. The blade 24, as illustrated in FIG. 7, is elevated out of contact with the sheet material, hence, the groove 148 has a length accommodating the plunging and lifting motions of the blade as well as the reciprocating motions during a cutting operation.

It will be understood that the flexible link 108 at the upper end of the reciprocating drive linkage cannot rotate about the $\theta$-axis 122 in view of the connection with the eccentric 78. Accordingly, the portion of the reciprocating drive linkage illustrated in FIG. 8 between the flexible link 108 and the blade 24 must accommodate the relative rotation of the blade and link in addition to transmitting the reciprocating motion between the same elements. The intermediate portion of the linkage is formed by a cylinder 160 having a swivelling end joint formed by a spherical bushing 162 at the upper end of the cylinder. The bushing 162 is connected to the flexible link 108 and is captured in the upper end of the cylinder 160 by a spacer 164 welded to the cylinder and a washer 166 fixed in the end of the cylinder. At the lower end of the cylinder the blade 24 is connected by a screw 168 to a slug 170 also welded in the cylinder. Accordingly, the flexible link 108 transmits reciprocating motions from the drive motor 60 to the blade 24 and the swivelling joint formed by spherical bushing 162 permits the blade to rotate about the $\theta$-axis 122 in response to the drive motor 120. Of course, the swivelling joint and flexible link 108 also cause the blade to plunge and lift in and out of cutting engagement with the sheet material.

At the lower end of the sleeve 142 in which the blade reciprocates, a flange plate 180 identified in FIG. 7 is fixedly secured so that the plate rotates about the $\theta$-axis 122 with the blade. Bolted to one side of the flange plate is a presser foot assembly comprised of a slide bracket 182, two slide rods 184 and 186 seen most clearly in FIG. 2 and a presser foot 188 which has a central cut-out or aperture through which the reciprocating blade 24 extends during a cutting operation. The slide rods 184 and 186 are fitted loosely within the bracket 182 so that the foot rests on the upper layer of the sheet material S under its own weight and prevents the material from lifting in a cutting operation during the upstroke of the blade.

It may be desirable to add a lifting solenoid to the presser foot assembly so that the foot may be automatically lifted off of the sheet material and held in an elevated position before and after a cutting operation. For this reason, a slip ring assembly comprised of stationary slip rings 190 and a rotating contact arm 192 are mounted on the cutting head. The assembly transmits control signals between the lower rotating portion of the head and the stationary upper portion attached to the mounting plate 40. The contact arm 192 is attached to a bushing 194 which in turn is fixed to the flange plate 180 by means of a pin 196 so that the bushing and contact arm are positively connected to the sleeve 142 and rotate about the $\theta$-axis 122 with the blade 24. Several sets of contact rings may be provided on the assembly to transmit information to or from other components on the rotating portion of the cutting head.

A lower blade guide 200 is also connected to the slide bracket 182 to support the lower end of the blade 24. The guide 200 has a slotted carbide insert which engages the sides and trailing edge of the cutting blade to prevent the blade from bending or twisting as it is forced along a cutting path through the sheet material.

With a relatively small blade 24 pointed at the lower end and supported in the cutting head with the central longitudinal blade axis and the $\theta$-axis substantially coincident, it is possible to drill holes in the sheet material for marking other purposes by plunging the blade into the sheet material at the point in the material where a hole is desired and spinning the blade in the material about the $\theta$-axis 122 with the $\theta$-drive motor 120. Such a drillilng operation is possible because the blade has a narrow profile from the leading cutting edge to the trailing edge, a distance preferably in the order of one-eighth of an inch. It should be noted that the drilling operation can be performed with or without stopping the reciprocation of the blade. The blade should be stopped in the lower position of its stroke if it is stopped at all during the drilling operation. Maintaining the reciprocating motion eliminates the difficulty of stopping the blade at a particular position and also reduces the twisting forces on the blade.

Also, with a narrow blade such as shown, sharp turns in fabric sheet material can be executed while cutting without lifting and plunging the blade. The cutting program controlling and defining a cutting operation of this type is, accordingly, simplified.

A blade sharpener, generally designated 210 in FIG. 7, is suspended from the lower portion of the cutting head and, therefore, translates with the head to make blade sharpening available at any interval in a cutting operation. The sharpener 210 is comprised of a pair of abrasive sharpening wheels 212, 214 shown in FIG. 11 located adjacent each side of and slightly spaced from the leading cutting edge of the blade 24. During a sharpening operation the cutting wheels 212, 214 are swung alternately into contact with the blade 24 and are driven rotatably about their own axes by spinning the entire sharpener 210 and the blade 24 about the $\theta$-axis 122. To operate the sharpening wheels in this manner, a planetary drive train is employed.

As shown most clearly in FIGS. 7 and 10, a large ring gear 220 is mounted on the bushing 194 for rotation relative to the bushing and the sleeve 142 holding the blade 24, but normally the ring gear rotates with the blade during a cutting operation. A planetary gear 222 is rotatably mounted in an offset arm 224 of the flange plate 180 and engages the teeth of the ring gear 220. The planetary gear 222 is fixedly attached to the upper end of the rotatable drive shaft 226 and a double-grooved drive pulley 228 is fixed to the mid-point of the shaft for rotation with the gear 222. A drive belt 230 formed by an elastomeric ring extends between the pulley 228 and the wheel 214 supported adjacent the blade 24 by means of a stand-off 232 shown most clearly in FIG. 11. Another drive belt (not shown) extends between the other groove in the pulley 228 to the wheel 212 supported on a stand-off 234 shown in FIG. 11.

Both the stand-offs 232 and 234 are anchored in a support block 236 which rotates freely on the lower end of the drive shaft 226. A friction coupling is formed between the block 236 and the drive pulley 228 by a pair of washers 238 and the friction force between the block and pulley can be varied by means of a pressure spring 240 manually adjusted by nut 242 below the block 236.

The blade sharpener 210 also includes a lock or brake assembly 250 suspended from the housing 140 and comprised of an electrically actuated solenoid 252 and a brake lever 254. The brake lever 254 is suspended by a bracket 256 in closely spaced relationship with the peripheral surface of the ring gear 220. The lever 254 is pivotally connected to the bracket 256 and is connected to the armature of the solenoid 252 so that withdrawal of the armature into the housing of the solenoid pivots the brake lever on the bracket in a clockwise direction as viewed in FIG. 7 and brings the lever and ring gear 220 into braking or locking relationship. The ring gear 220 is then held fixed relative to the housing 140 and mounting plate 40.

With the brake assembly energized to hold the ring gear 220 fixed, rotation of the cutting blade 24 by means of the $\theta$-drive motor 120 causes the planetary gear 222, the drive pulley 228 and the sharpening wheels 212 and 214 to revolve about the $\theta$-axis 122 with the blade and, at the same time, imparts rotary motion to the sharpening wheels about their own axes. Also, the frictional coupling formed between the pulley 228 and support block 236 biases one or the other of the sharpening wheels into contact with the blade for sharpening the leading edge of the blade at one side. The precise sharpening wheel brought into contact with the blade depends upon of the direction of rotation of the blade 24 and rotatable drive portion of the sharpener 210 by the motor 120 about the $\theta$-axis 122. Rotation in the clockwise direction as viewed in FIG. 11, for example, brings the sharpening wheel 212 into contact with the blade 24 and rotation in the counterclockwise direction brings sharpening wheel 214 into contact with the blade. By reciprocating the blade at the same time that the blade is rotated, the sharpening wheels will cover substantially the full extent of the cutting edge. The sharpening operation is performed when the blade is withdrawn from the sheet material since the spinning of the blade about the $\theta$-axis 122 by the drive motor 120 provides the motive forces for the sharpener 210.

The sharpening operation may be performed at periodic intervals in a cutting operation or whenever the accumulated cutting paths traversed by the blade exceed a predetermined length. When the sharpening operation is finished, the drive motor 120 is de-energized to stop the spinning of the blade 24 about the $\theta$-axis 122 and the solenoid 252 is de-energized to release the ring gear 220. A centering spring 260 then operates upon the support block 236 to move the cutting wheels 212 and 214 to a centered position about the blade 24 and out of contact with the leading, cutting edge.

While the present invention has been described in a preferred embodiment, it will be understood that numerous modifications and substitions can be had to the specific structure and methods disclosed without departing from the spirit of the invention. For example, the torque-transmitting coupling between the reciprocating blade 24 and the rotating pulley 130 need not necessarily be formed by the grooved sleeve 142 and the tang 150 because equivalent splined couplings may serve the same function. The disclosed torque-transmitting coupling is advantageous in that it provides a vertical guide for the reciprocating motions of the blades as well as a positive coupling for the $\theta$-rotations and spinning of the blade during sharpening and drilling operations. The reciprocating mechanism including the flexible link 108 and eccentric 78 may be replaced by equivalent cranks and linkages and the details of the drive trains connecting the blade 24 with the motors 60 and 120 may be varied as desired. The mounting plate 40 to which all of the components are attached is not essential but is desirable since it is possible to replace an entire cutting head by simply detaching the plate of one head and re-attaching the plate of another head. Of course, the cutting head can be employed for cutting without the specific blade sharpener 210 illustrated and the blade sharpener has utility in cutting heads other than the specific head illustrated. Accordingly, the present invention is described in a preferred embodiment by way of illustration rather than limitation.

I claim:

1. Apparatus for cutting sheet material held on a support surface of a cutting table in a spread condition comprising:

a mounting platform positioned above the support surface and movable relative to the table parallel to the support surface;

motor driven translating means connected with the mounting platform for moving the platform in a controlled manner parallel to the sheet material on the support surface;

a tool support mounted on the platform above the support surface of the table and movable relative to the platform toward and away from the support surface and sheet material thereon;

a reciprocating cutting blade suspended from the tool support and movable with the tool support from a lowered position in which the blade reciprocates along its own axis in cutting engagement with the sheet material on the table and an elevated position in which the blade reciprocates along its own axis out of engagement with the material;

a blade drive motor fixedly mounted on the mounting platform;

reciprocating drive means connected between the blade drive motor and the cutting blade for reciprocating the blade along its own axis in both the lowered and the elevated positions, said drive means also including a swivelling connection between the mounting platform and the cutting blade to permit the blade to be oriented about its own axis while reciprocating;

an orientation drive motor fixedly mounted on the mounting platform; and orientation drive means connected between the orientation drive motor and the reciprocating cutting blade for orienting the blade about its own axis and including a torque-transmitting sliding connection between the mounting platform and the cutting blade which sliding connection accommodates the reciprocating motion of the blade at both the lowered and elevated positions and at blade positions in between, whereby the cutting blade can be reciprocated and oriented at either the elevated or lowered positions and positions in between by means of the blade drive motor and orientation motor fixedly mounted on the mounting platform.

2. Apparatus for cutting as defined in claim 1 wherein the sliding connection between the cutting blade and the orientation drive means has a mating tang and groove extending generally in a direction perpendicular to the support surface.

3. Apparatus for cutting as defined in claim 1 wherein the orientation drive means includes a toothed drive pulley and a toothed belt extending between the orientation drive motor and the pulley, and the sliding connection comprises a grooved member connected to the drive pulley and having a groove accommodating the cutting tool.

4. Apparatus for cutting sheet material as in claim 1 wherein: the translating means includes a motor-driven carriage; and the mounting platform is supported on the carriage.

5. Apparatus for cutting sheet material as defined in claim 1 wherein:

the reciprocating drive means includes a rotatably driven crank member mounted on the tool support; and the reciprocating cutting blade is connected to the crank member.

* * * * *